US012747866B2

(12) United States Patent
Choi et al.

(10) Patent No.: US 12,747,866 B2
(45) Date of Patent: Sep. 29, 2026

(54) HOME APPLIANCE

(71) Applicant: LG ELECTRONICS INC., Seoul (KR)

(72) Inventors: Na Kyeom Choi, Seoul (KR); Dong Yeol Lee, Seoul (KR); Dong Woo Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 22 days.

(21) Appl. No.: 18/938,544

(22) Filed: Nov. 6, 2024

(65) Prior Publication Data

US 2025/0172295 A1 May 29, 2025

(30) Foreign Application Priority Data

Nov. 28, 2023 (KR) ..... 10-2023-0167878

(51) Int. Cl.
*F24C 15/08* (2006.01)

(52) U.S. Cl.
CPC ..... *F24C 15/083* (2013.01)

(58) Field of Classification Search
CPC ..... F24C 15/083; F24C 15/086
USPC ..... 248/680
See application file for complete search history.

(56) References Cited

U.S. PATENT DOCUMENTS 8,220,770 B2 * 7/2012 Justis ..... D06F 39/125 248/677
10,663,175 B2 * 5/2020 Jang ..... F24C 15/086
2013/0147336 A1 * 6/2013 Lee ..... E05D 11/00 312/405

FOREIGN PATENT DOCUMENTS

KR 10-2018-0131307 12/2018

* cited by examiner

*Primary Examiner* — Todd M Epps
(74) *Attorney, Agent, or Firm* — KED & Associates, LLP

(57) ABSTRACT

A home appliance is disclosed. The home appliance may include a support shaft coupled to a connector so as to be able to ascend and descend, a support that is in contact with a floor surface and supports the support shaft from below, a boss coupled to the support shaft, and a coupling portion that couples the boss to a main body. The boss may be coupled to the support shaft while supporting the support shaft such that the support shaft maintains a predetermined posture. When a posture of the support shaft is the predetermined posture, the support may be in contact with the floor surface at a location biased forward of the support shaft.

21 Claims, 14 Drawing Sheets

HOME APPLIANCE

CROSS-REFERENCE TO RELATED APPLICATION(S)

This application claims priority to and the benefit of Korean Patent Application No. 10-2023-0167878, filed in Korea on Nov. 28, 2023, the disclosure of which is incorporated herein by reference in its entirety.

BACKGROUND

1. Field

A home appliance is disclosed herein.

2. Background

A cooking appliance is a home appliance for cooking food or other items (hereinafter, collectively "food"), installed in a kitchen space and that cooks the food based on an intention of a user. Such a cooking appliance may be categorized into various types depending on a heat source used or a form, and a type of fuel used.

When categorizing cooking appliances based on a form of cooking the food, they may be categorized into open and closed cooking appliances depending on a form of a space where the food is placed. The closed cooking appliances may include an oven, or a microwave oven, for example, and the open cooking appliances may include a cooktop, or a hob, for example.

The closed cooking appliance is a cooking appliance that shields a space in which the food is placed and heats the shielded space to cook the food. In the closed cooking appliance, a chamber, which is a space in which the food is placed and that is shielded when the food is to be cooked, that is, a cooking chamber, is disposed inside of a main body. Such a cooking chamber becomes a space in which the food is actually cooked.

The closed cooking appliance is usually equipped with a door that opens and closes the cooking chamber formed inside of the main body. As the door for the closed cooking appliance, depending on an opening and closing form thereof, a horizontally opening door, a vertically opening door, or a sliding door, for example, may be applied. Among those, the most commonly used door is the horizontally opening door or the vertically opening door.

A heat source is disposed in an internal space of the cooking chamber that is opened and closed by the door. The heat source is configured to heat the cooking chamber. A gas burner, or an electric heater, for example, may be used as such heat source.

A base frame may be disposed under the main body. The base frame may form a bottom surface of the main body, and a leg may be installed on the base frame. The leg may be screw-coupled to the base frame to support the main body from below.

For example, a hole into which the leg is inserted may be defined in the base frame, and the leg may be coupled to the oven as the leg with a thread formed thereon is inserted into the hole. A height of the cooking appliance may be adjusted by adjusting an inserted length of the leg.

When a center of gravity of the cooking appliance is biased to one side of the cooking appliance, a risk of the cooking appliance tipping over increases. For example, the center of gravity of the cooking appliance may be biased forward because of the door protruding forward of the main body while opening the cooking chamber.

In particular, in a state in which the vertically opening door that opens the cooking chamber protrudes forward of the main body, when the food, or a dish, for example, is placed on a top of the door, the risk of the cooking appliance tipping over increases significantly. When the cooking appliance tips over, the cooking appliance and the dish or the food contained inside may be damaged, and a risk of injury to the user adjacent to the cooking appliance increases.

BRIEF DESCRIPTION OF THE DRAWINGS

Embodiments will be described in detail with reference to the following drawings in which like reference numerals refer to like elements, and wherein.

DETAILED DESCRIPTION

Figure 1:
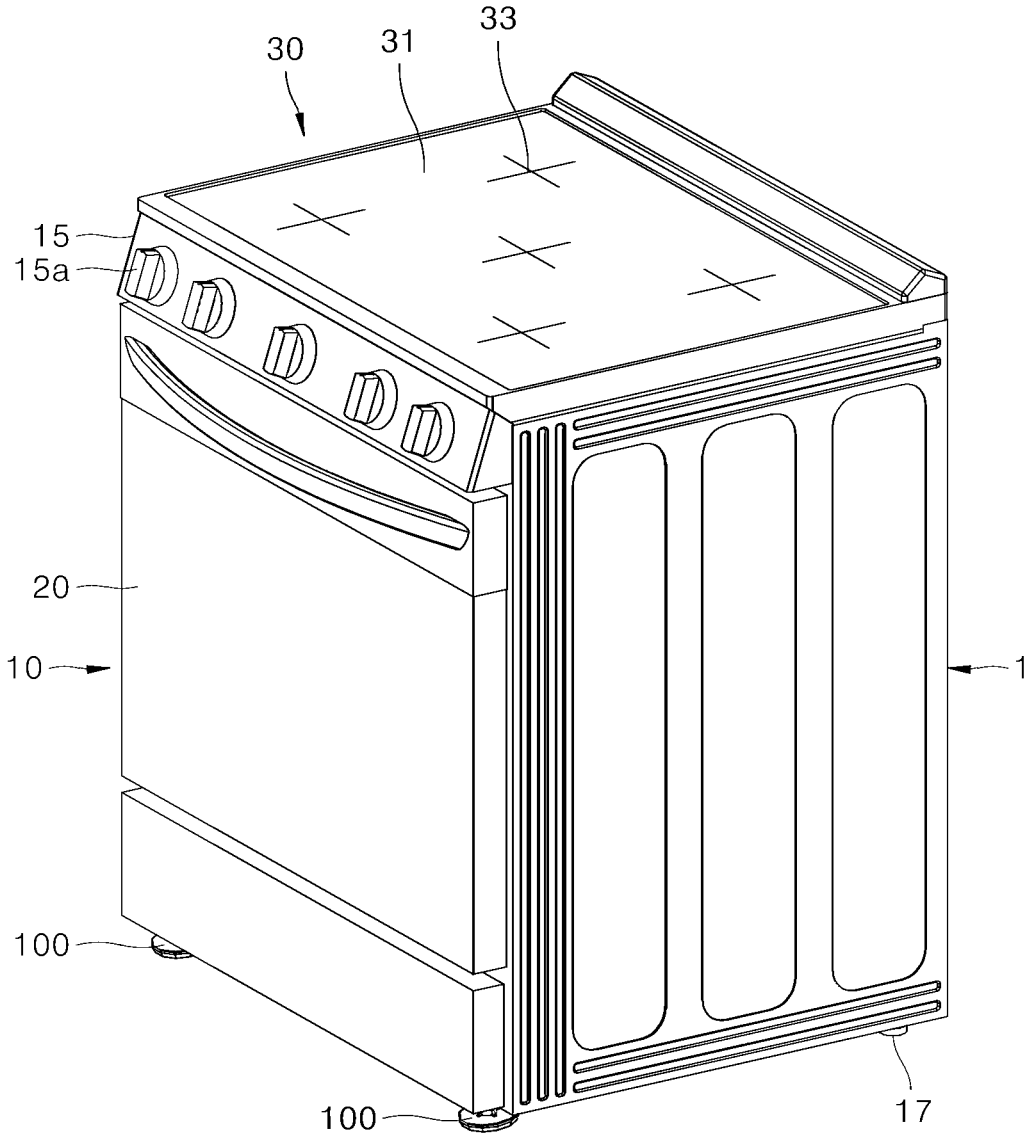
FIG. 1 is a perspective view of a home appliance according to an embodiment.

Embodiments will be described hereinafter with reference to the attached drawings, so that those skilled in the art in the technical field to which the embodiments belong may easily practice the technical ideas. In describing the embodiments, when it is determined that description of publicly known technology related to the embodiments may unnecessarily obscure the gist, such description thereof has been omitted. In the drawings, identical or like reference numerals are used to indicate identical or like components.

Although first, second, for example, are used to describe various components, these components are not limited by such terms. Such terms are only used to distinguish one component from another component, and unless specifically stated to the contrary, a first component may also be a second component.

The embodiments may not be limited to the embodiments to be disclosed below, but may have various changes and may be implemented in various different forms. The embodiments are provided only to ensure that the disclosure is complete and to fully inform a person having ordinary skill in the art of the scope. Accordingly, the embodiments are not limited to the embodiments disclosed hereinafter, and but should be understood to include all changes, equivalents, or substitutes included in the technical spirit and scope, as well as substitutions of components between different embodiments or additions of components.

The attached drawings are only intended to facilitate easy understanding of the embodiments disclosed herein, and the technical ideas disclosed herein are not limited by the attached drawings. It should be understood that embodiments encompass all changes, equivalents, or alternatives that fall within the scope and spirit. In the drawings, the components may be exaggerated or minimized in size or thickness for convenience of understanding for example, but this should not be construed as limiting the scope.

The terms used herein are used only to describe specific implementations or embodiments, and are not intended to limit the present disclosure. In addition, singular expressions include plural expressions unless the context clearly indicates otherwise. As used herein, terms such as "include" and "composed of" are intended to specify the presence of features, numbers, steps, operations, components, parts, or combinations thereof described herein. In other words, the terms such as "include" and "composed of" used herein should be understood as not excluding in advance the possibility of the presence or addition of one or more other features, numbers, steps, operations, components, parts, or combinations thereof.

Although first, second, for example, are used to describe various components, these components are not limited by such terms. Such terms are only used to distinguish one component from another component.

It should be understood that when a component is described as being "connected to" or "coupled to" another component, the components may be directly connected or coupled to each other, but other components may be "interposed" therebetween. On the other hand, it should be understood that when a component is described as being "directly connected to" or "directly coupled to" another component, no other components are interposed therebetween.

It should be understood that when a first component is described to be disposed "on" or "under" a second component, the first component may not only be disposed directly on the second component, but also be disposed on the second component with a third component interposed therebetween.

Unless otherwise defined, all terms including technical and scientific terms used herein have the same meaning as commonly understood by one of ordinary skill in the art to which this inventive concept belongs. Terms, such as those defined in commonly used dictionaries, should be interpreted as having a meaning that is consistent with their meaning in the context of the relevant art and will not be interpreted in an idealized or overly formal sense unless expressly so defined herein.

With a home appliance disposed on a floor, a side at which a door is installed is defined as a front side, with a center of the home appliance as a reference point. Therefore, a side of the appliance through which one enters as the door is opened is defined as a rear side. For convenience, a direction passing through both front and rear sides may be defined as a first direction. Then, the front side may be referred to as one side of the first direction, and the rear side may be referred to as the other side of the first direction.

In addition, a direction of gravity may be defined as a downward direction, and a direction opposite to the direction of gravity may be defined as an upward direction.

In addition, a horizontal direction perpendicular to a frontward and rearward direction of the home appliance, that is, a widthwise direction of the home appliance when looking at the home appliance from a location in front of the door of the home appliance, may be referred to as a left and right or lateral direction. For convenience, the leftward and rightward or lateral direction may be referred to as a second direction. Then, a right side may be referred to as one side in the second direction, and a left side may be referred to as the other side in the second direction.

In addition, the widthwise direction of the home appliance may be referred to as a lateral direction. Then, the right side may be referred to as one side in the lateral direction, and the left side may be referred to as the other side in the lateral direction.

Further, the above-mentioned vertical direction may be referred to as a third direction. Then, an upper side may be referred to as one side in the third direction, and a lower side may be referred to as the other side in the third direction.

Further, the above-mentioned vertical direction may be referred to as a longitudinal direction. Then, the frontward and rearward direction and the leftward and rightward direction, that is, the first direction and the second direction, may be collectively referred to as a horizontal direction.

Throughout the present disclosure, "A and/or B" means A, B, or A and B, unless otherwise specified, and "C to D" means C inclusive to D inclusive unless otherwise specified.

Figure 2:
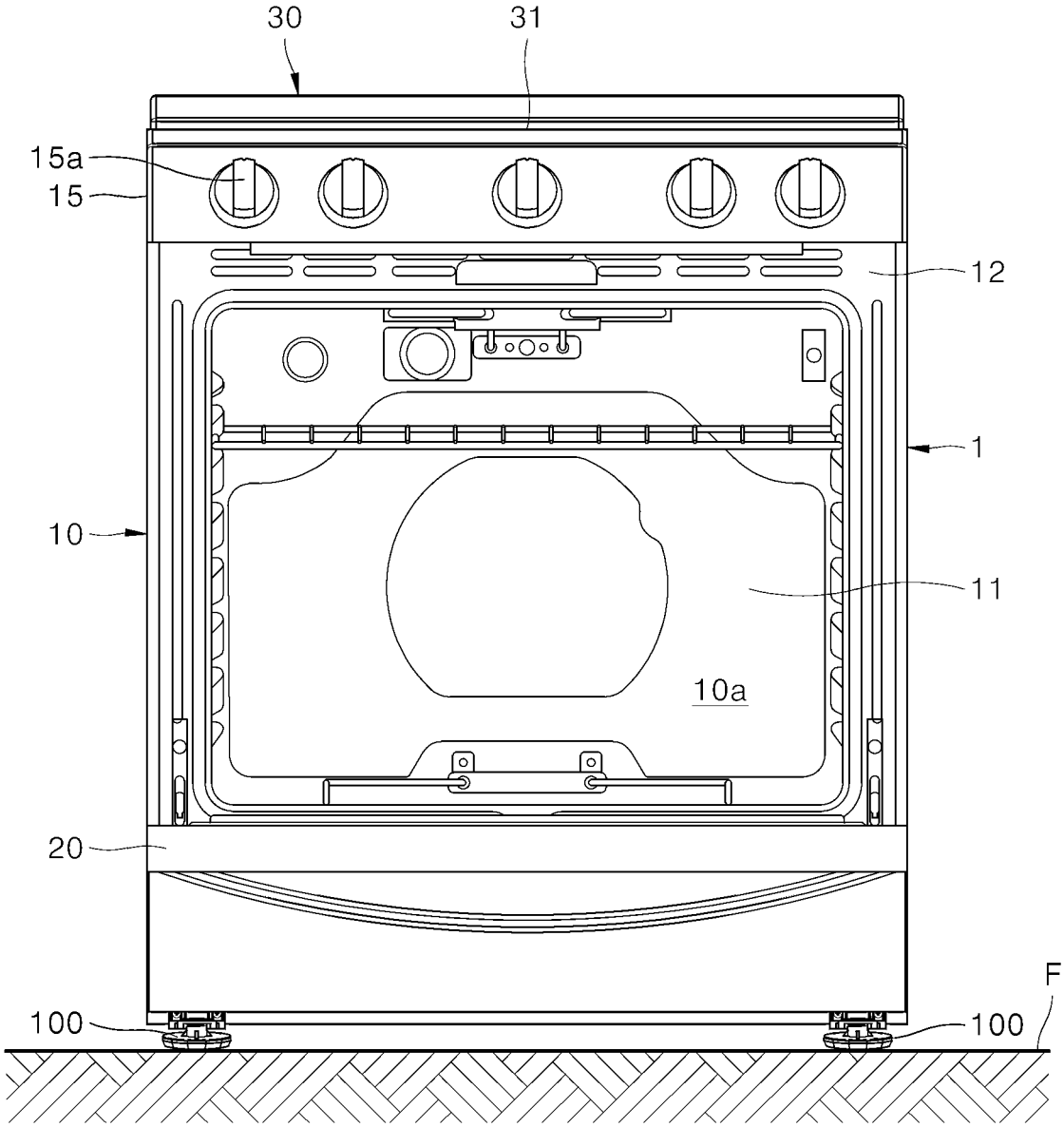
FIG. 2 is a front view showing an internal structure of the home appliance shown in FIG. 1.
Figure 3:
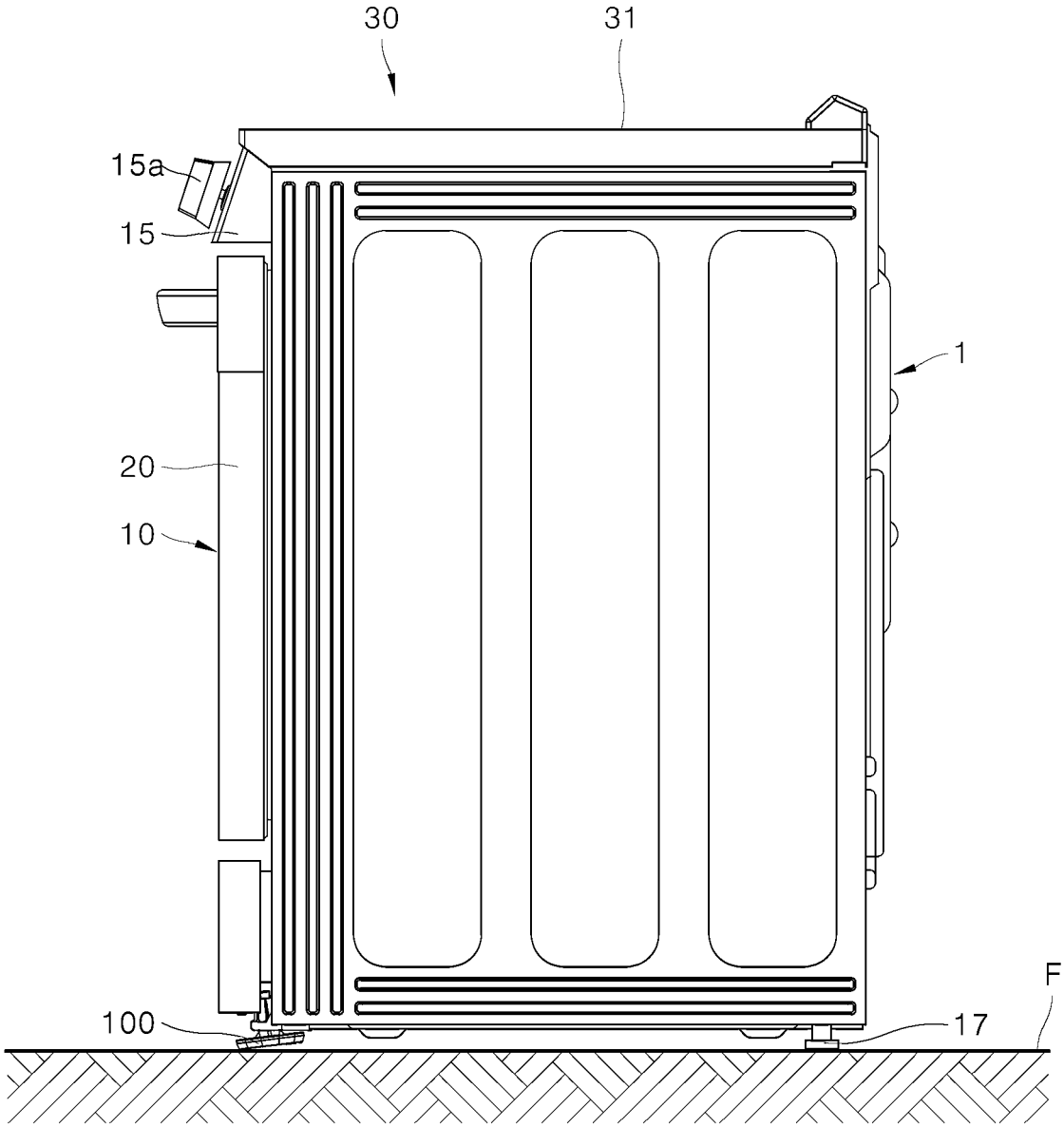
FIG. 3 is a side view of the home appliance shown in FIG. 1.

FIG. 1 is a perspective view of a home appliance according to an embodiment. FIG. 2 is a front view showing an internal structure of the home appliance shown in FIG. 1. FIG. 3 is a side view of the home appliance shown in FIG. 1. In FIG. 2, a front surface of the home appliance is shown with a door and a lower finishing panel removed.

Referring to FIGS. 1 to 3, the home appliance according to an embodiment may have an outer appearance formed by a main body 1. The main body 1 may be formed an approximately rectangular parallelepiped shape, for example. The main body 1 may be made of a material having a predetermined strength to protect multiple components installed in an internal space thereof.

The main body 1 may include a cavity 11. Walls of the cavity 11 may form a skeleton of the main body 1.

In addition, the main body 1 may further include a first front panel 12. The first front panel 12 may be disposed in front of the cavity 11 to form a front surface of the main body 1.

As another example, the first front panel 12 may not be formed separately from the cavity 11, and a front surface of the cavity 11 may form the front surface of the main body 1. For example, the cavity 11 and the first front panel 12 may be disposed in the main body 1 in an integrally formed shape.

An internal space may be defined inside of the main body 1. As an example, an internal space may be defined inside of the cavity 11, and the internal space may be open forward.

In this embodiment, the home appliance is illustrated to be provided in a form of a range on an oven. The home appliance provided in the form of the range on the oven as such may provide both a function of an oven, which is a closed cooking appliance, and a function of a cooktop, which is an open cooking appliance. The home appliance may include an oven 10 and a cooktop 30.

A cooking chamber 10*a* may be defined inside of the oven 10. In the oven 10, food may be cooked while the inside of the cooking chamber 10*a* is heated. The cooking chamber 10*a* may be defined inside of the cavity 11. In addition, an opening to open the cooking chamber 10*a* forward may be defined inside of the first front panel 12.

For example, the internal space defined in the main body 1 may be the cooking chamber 10*a*. The cooking chamber 10*a* may be formed in a shape of a hexahedron with an open front surface. In a state in which the cooking chamber 10*a* is shielded, the oven 10 may heat the internal space of the cooking chamber 10*a* to cook the food. That is, in the oven 10, the cooking chamber 10*a* is a space in which the food is actually cooked.

A heater that heats the cooking chamber 10*a* may be disposed in the oven 10. The heater may be a heating apparatus that uses gas fuel or may be a heater that uses electricity.

A door 20 that selectively opens and closes the cooking chamber 10*a* may be pivotably disposed on the oven 10. For example, the door 20 may be provided in a form that opens and closes the cooking chamber 10*a* in a pull-down manner in which an upper end of the door 20 pivots in a vertical direction around a lower end.

A control panel 15 may be provided on an upper portion of a front surface of the oven 10. The control panel 15 may form a portion of a front surface outer appearance of the home appliance. The control panel 15 may include a knob 15*a* configured to adjust an operation of the oven 10, a switch, or a display that displays an operating state of the oven 10, for example.

The cooktop 30 may be disposed on top of the oven 10. The cooktop 30 is configured to heat food or a container containing food placed on top of the cooktop 30.

The cooktop 30 may be provided with a top plate 31 that forms a top surface outer appearance of the cooktop 30. In addition, the cooktop 30 may include at least one burner 33 that heats food to be cooked or an object-to-be-heated containing food (hereinafter, referred to as an "object-to-be-heated"). For example, the burner 33 may include a working coil or a heating coil that uses electricity.

As another example, the burner 33 may be a gas burner that uses gas fuel. In this way, a structure of the burner 33 may be changed depending on a type of heat source used.

Figure 4:
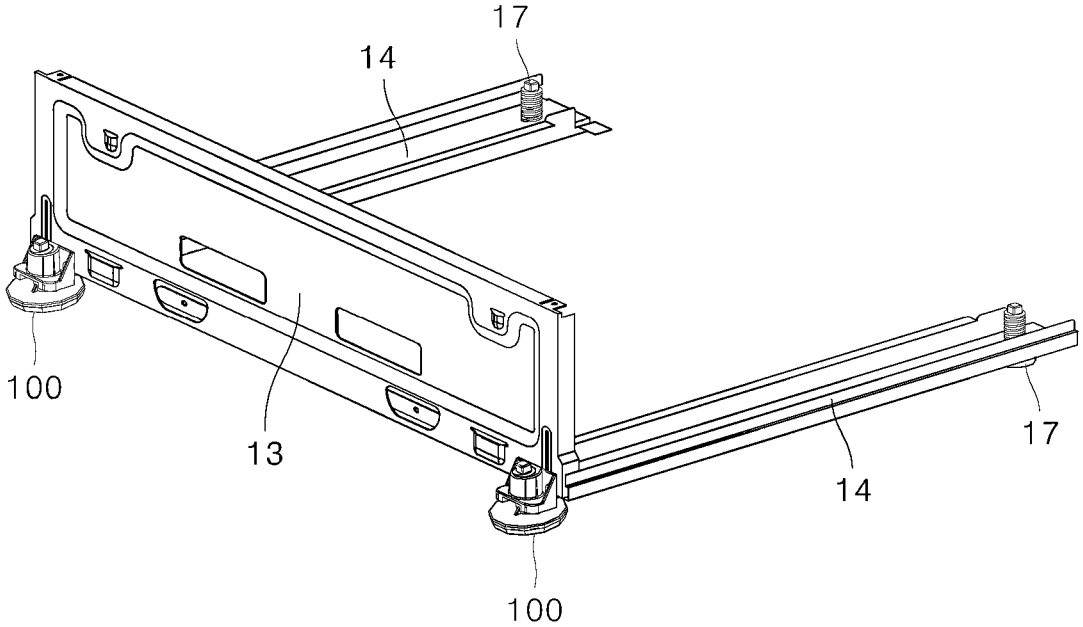
FIG. 4 is a schematic diagram of a portion of the home appliance shown in FIG. 1.
Figure 5:
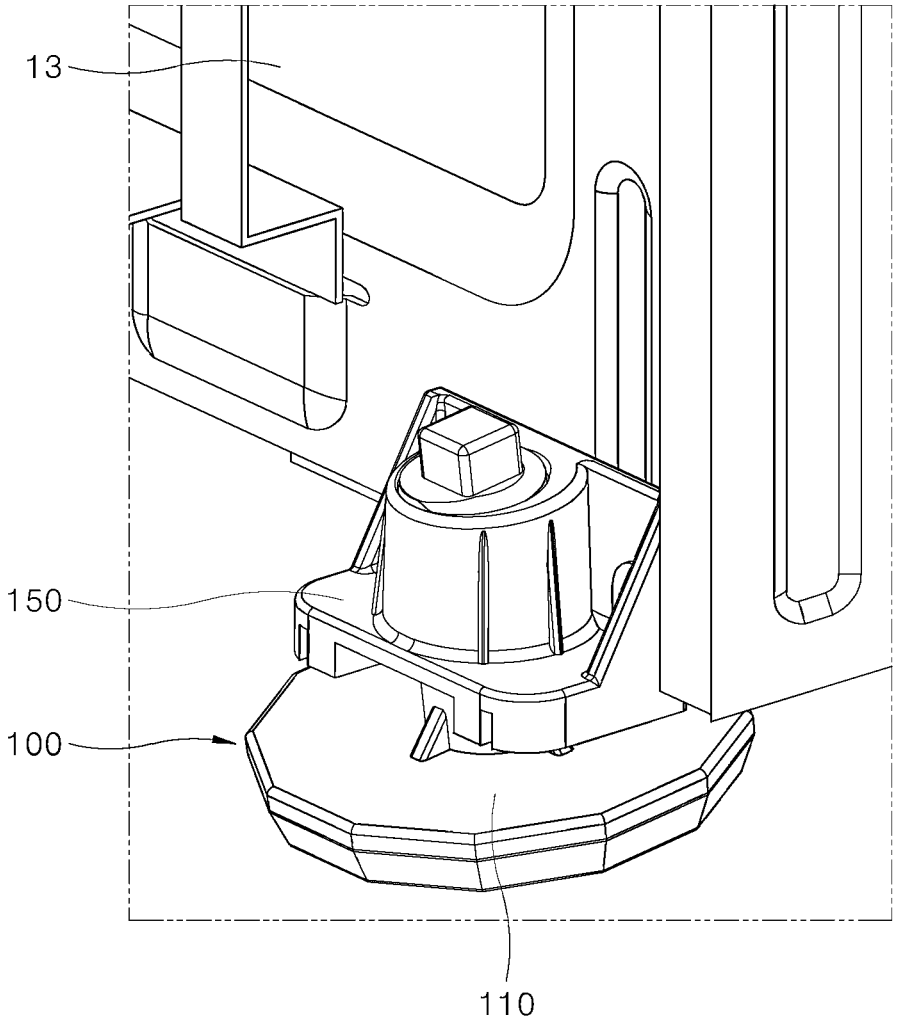
FIG. 5 is an enlarged schematic diagram of a leg assembly shown in FIG. 1.

FIG. 4 is a schematic diagram showing a portion of the home appliance shown in FIG. 1. FIG. 5 is an enlarged schematic diagram showing a leg assembly shown in FIG. 1.

Referring to FIGS. 2 to 5, the home appliance according to this embodiment may include a second front panel 13. The second front panel 13 may be disposed under the first front panel 12.

For example, the second front panel 13 may be disposed forward of the cavity 11, and may be disposed below the first front panel 12 and the cavity 11. The second front panel 13 may be coupled to at least one of the first front panel 12 or structure forming the cavity 11.

In addition, the home appliance according to this embodiment may further include a base frame 14. The base frame 14 may be disposed under the cavity 11. For example, the base frame 14 may be formed in a rod shape that extends in the frontward and rearward direction.

Under the cavity 11, a pair of base frames 14 may be disposed to be laterally spaced apart from each other by a predetermined spacing. For example, the pair of base frames 14 may be spaced apart from each other by a spacing corresponding to a lateral length of the second front panel 13.

A back plate may be disposed at a rear of the cavity 11, and the back plate may be coupled to a rear surface of the cavity 11 and fixed to the cavity 11. Each base frame 14 may be coupled to the second front panel 13 and the back plate. For example, a front end of each base frame 14 may be coupled to the second front panel 13, and a rear end of each base frame 14 may be coupled to the back plate.

The base frame 14 provided in such a form may connect the second front panel 13 with the back plate, and may be coupled to the second front panel 13 and the back plate. The base frame 14 may improve structural stability of a lower portion of the home appliance by forming a coupled structure of the second front panel 13, the back plate, and the base frame 14 at the lower portion of the home appliance.

In addition, a leg assembly 100 may be disposed at the lower portion of the home appliance. The leg assembly 100 may be disposed at the lower portion of the home appliance under the main body 1 to support the main body 1. The leg assembly 100 may include a supporter 110.

The supporter 110 may be disposed between a floor surface F on which the home appliance is installed and the main body 1. The supporter 110 may be in contact with the floor surface F and may support the main body 1 from below.

In addition, the leg assembly 100 may include a connector 150. The connector 150 is configured to couple the supporter 110 to the main body 1. That is, the supporter 110 may be coupled to the main body 1 to support the main body 1 from below, and may be coupled to the main body 1 via the connector 150 coupled to the main body 1.

In addition, the home appliance may further include a rear leg 17. The rear leg 17 may be disposed at a bottom of the home appliance together with the leg assembly 100. The rear leg 17 may be disposed at a rear of the leg assembly 100.

That is, the leg assembly 100 and the rear leg 17 may be disposed to be spaced apart from each other by a predetermined spacing in the frontward and rearward direction. For example, the leg assembly 100 and the rear leg 17 may be spaced apart from each other by a spacing close to a length in the frontward and rearward direction of the main body 1.

In this embodiment, the main body 1 is illustrated as being supported by a pair of leg assemblies 100 and a pair of rear legs 17. For example, a front side of the main body 1 may be supported by the pair of leg assemblies 100, and the rear side of the main body 1 may be supported by the pair of rear legs 17.

Figure 6:
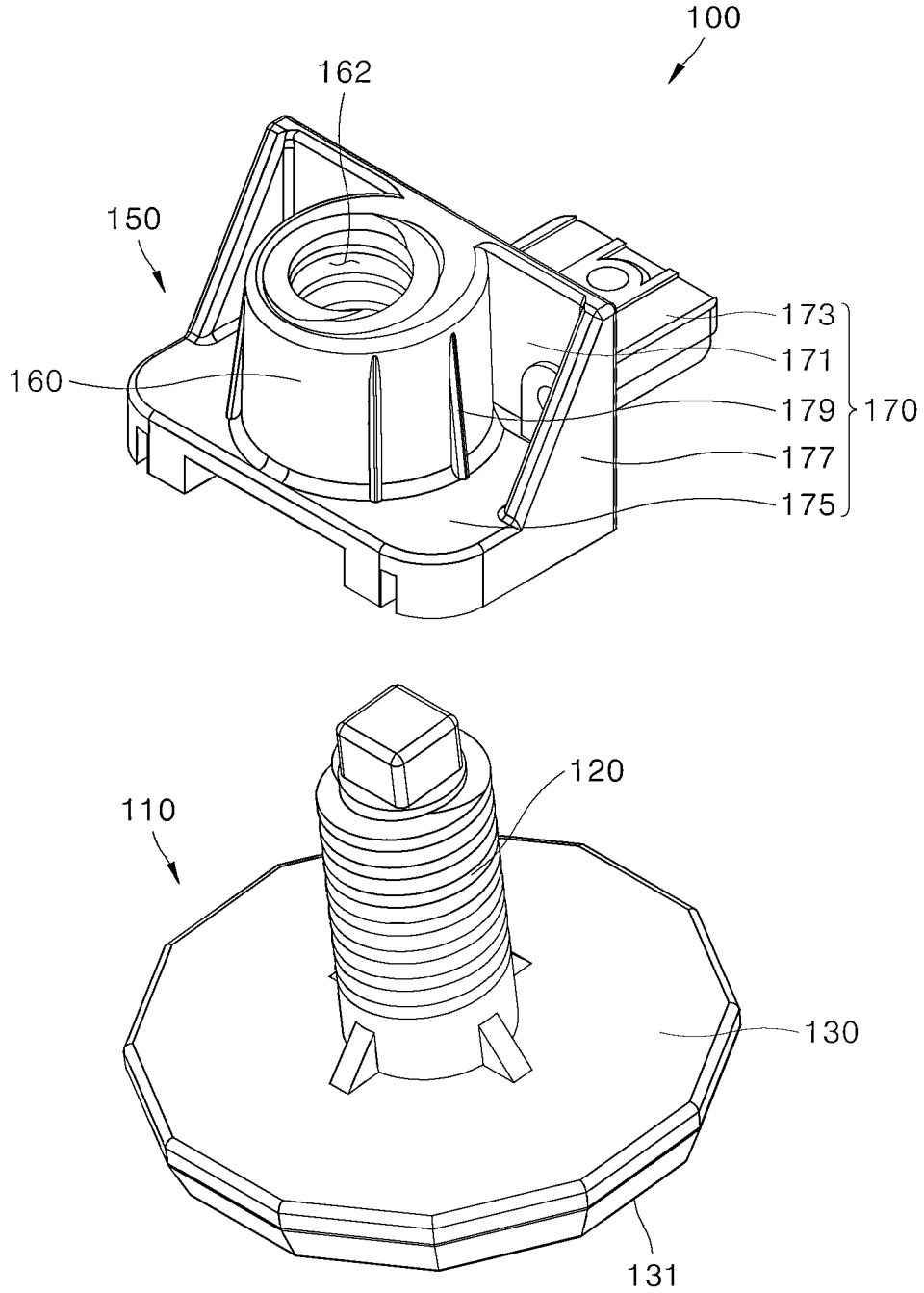
FIG. 6 is an exploded perspective view of a leg assembly shown in FIG. 5.
Figure 7:
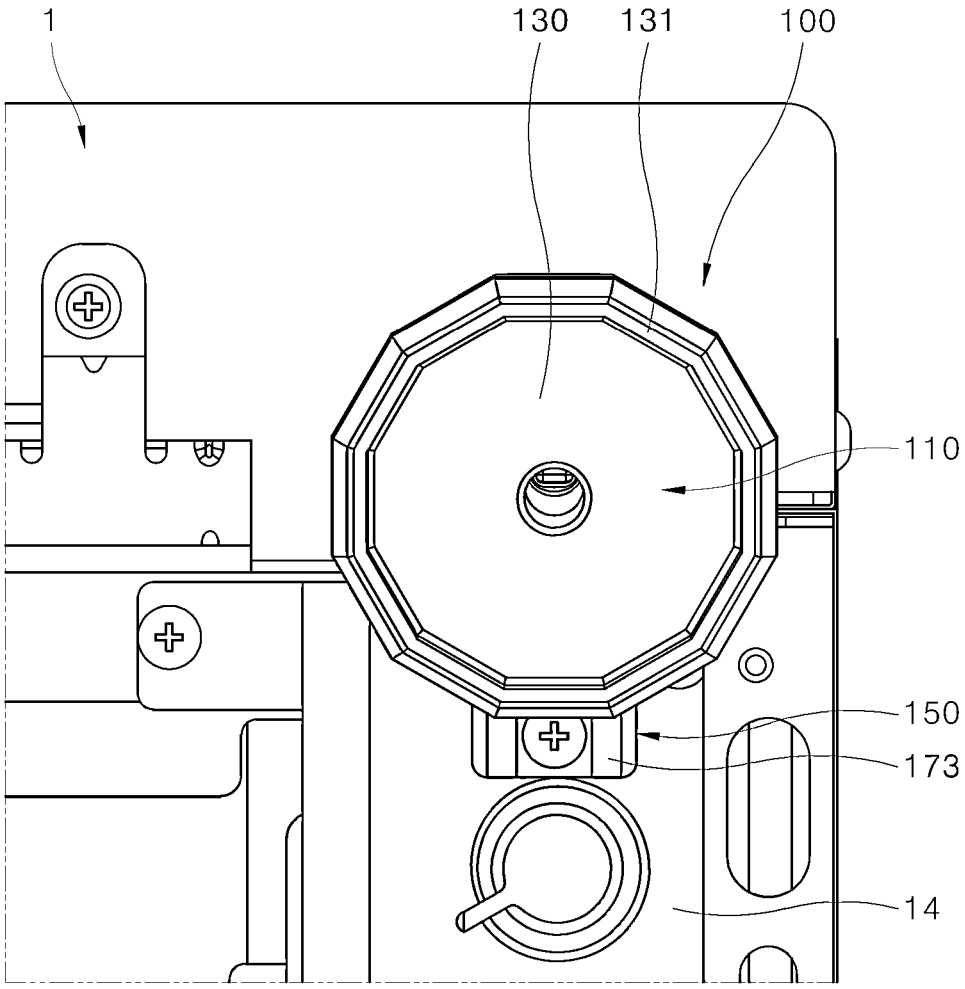
FIG. 7 is a bottom view of the leg assembly shown in FIG. 5.
Figure 8:
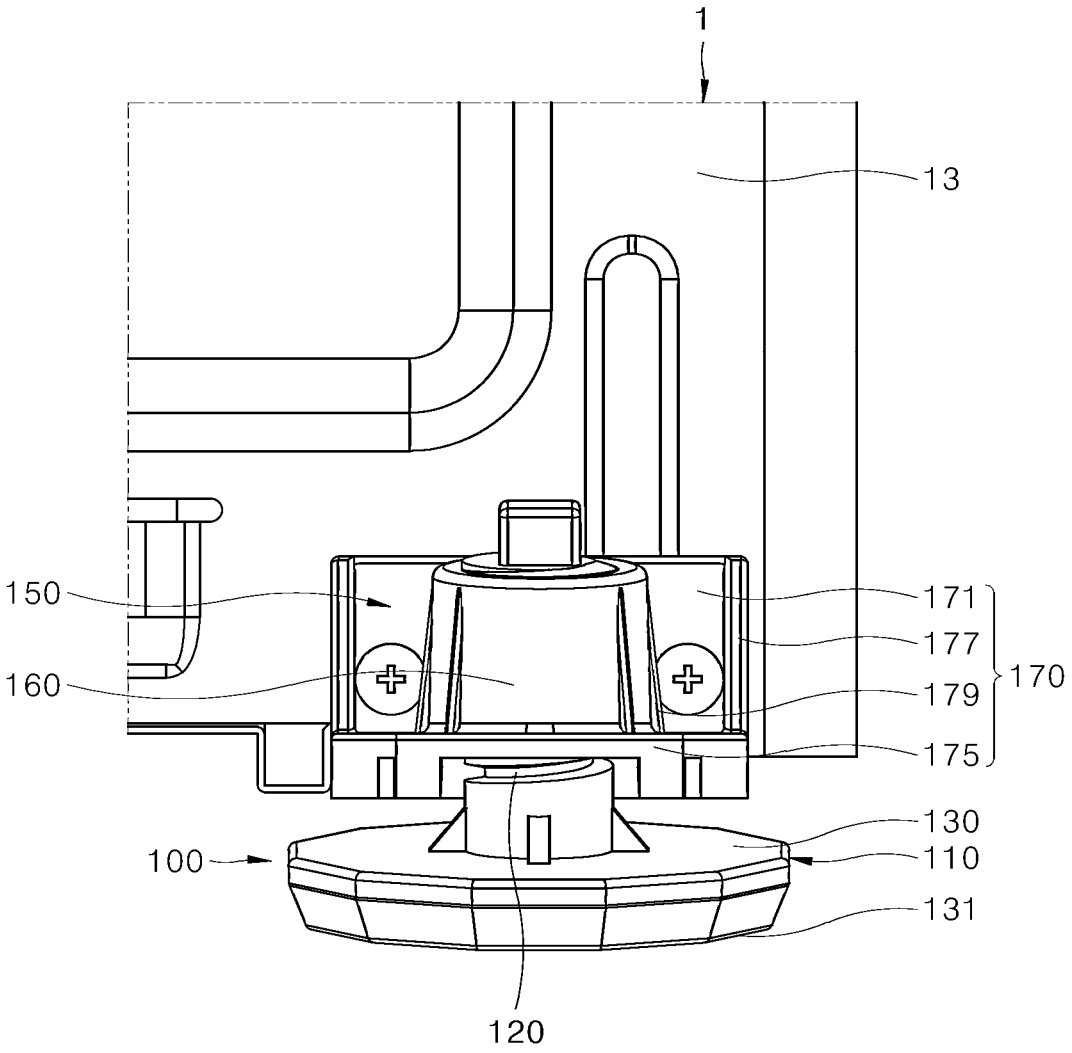
FIG. 8 is a front view of the leg assembly shown in FIG. 5.
Figure 9:
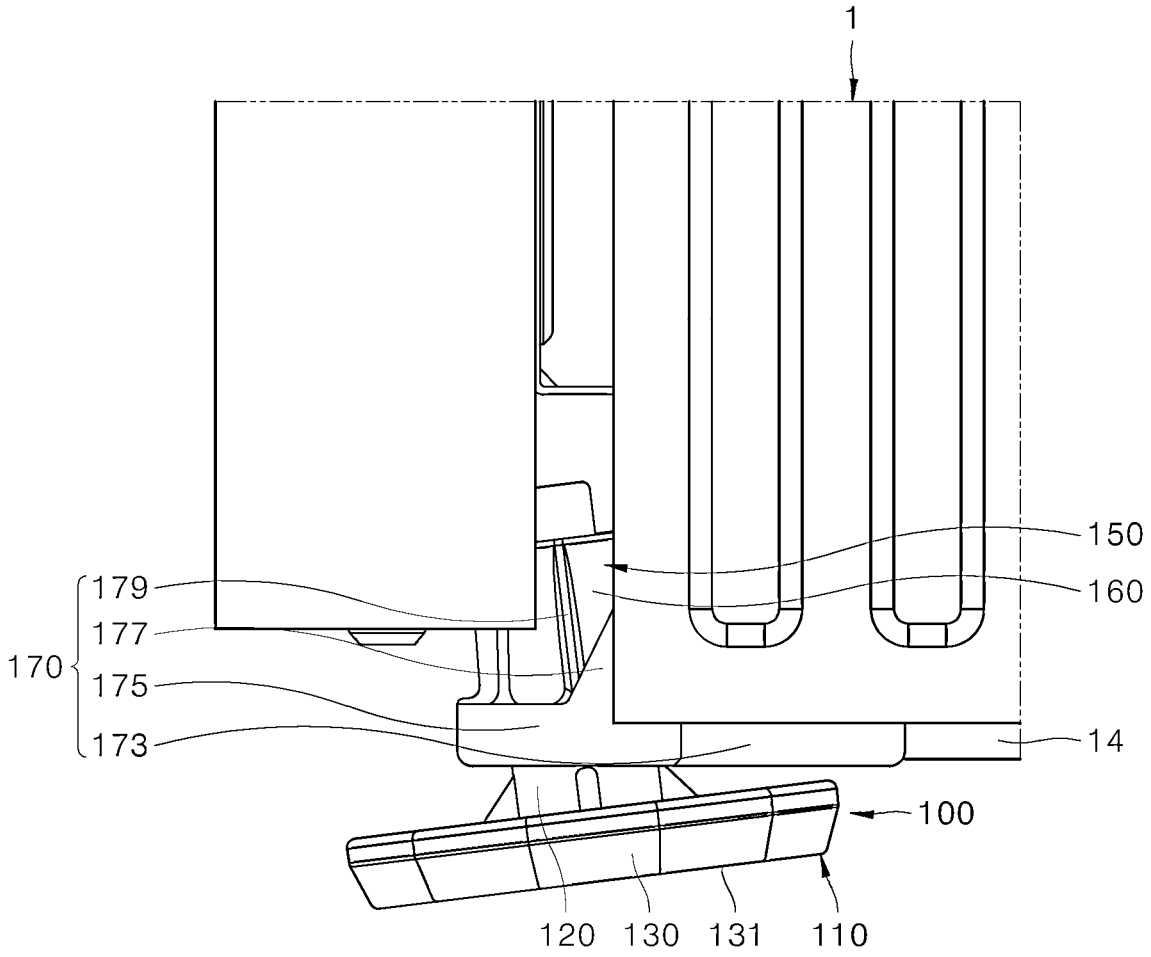
FIG. 9 is a side view of the leg assembly shown in FIG. 5.
Figure 10:
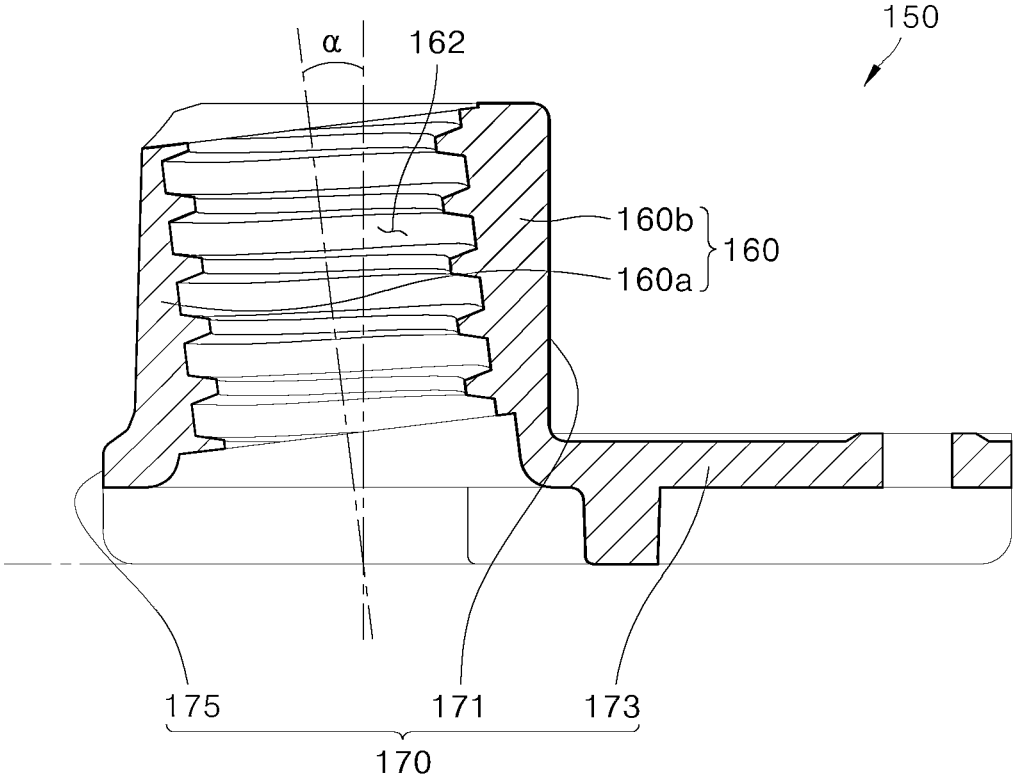
FIG. 10 is a side cross-sectional view showing an internal structure of the connector shown in FIG. 9.
Figure 11:
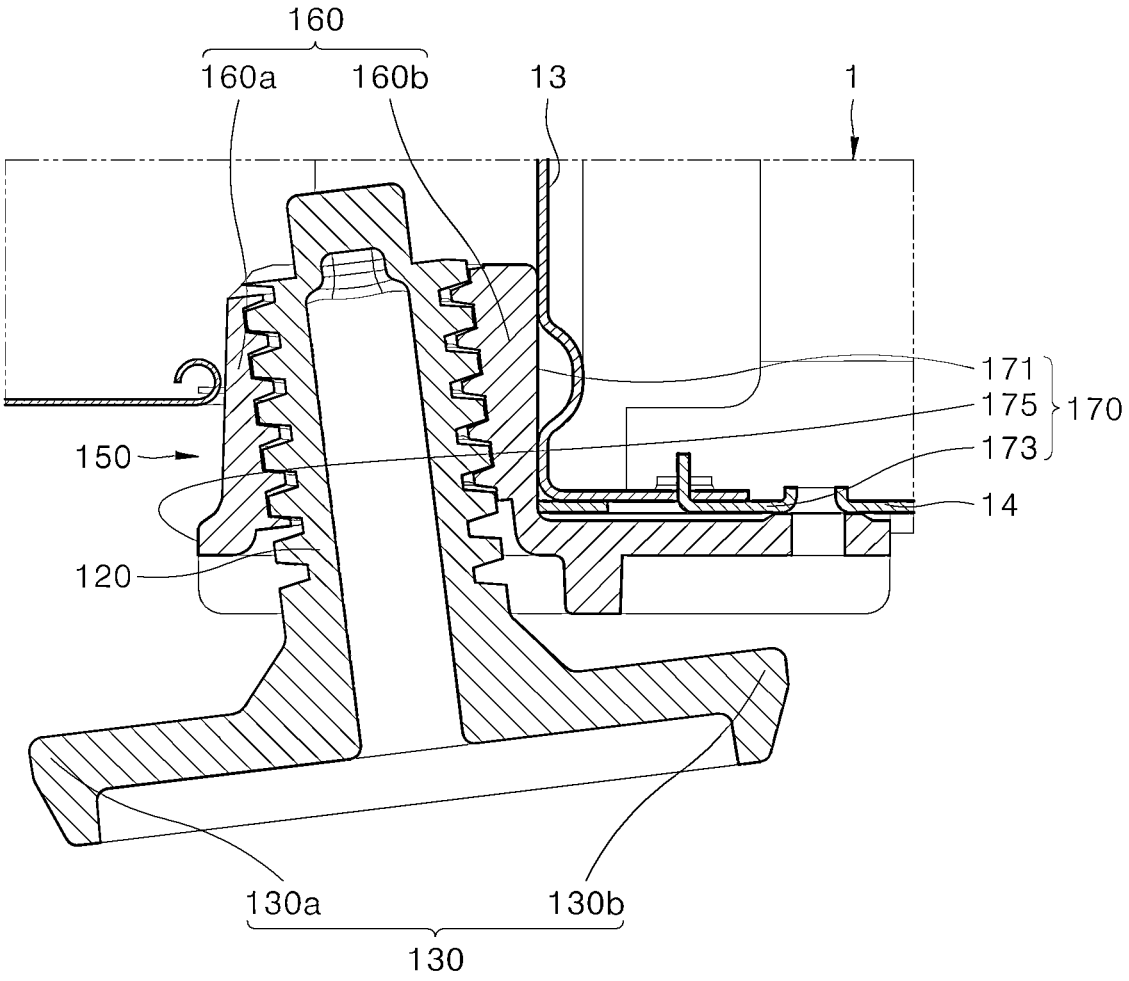
FIGS. 11 and 12 are side cross-sectional views showing an internal structure of the leg assembly shown in FIG. 9.
Figure 12:
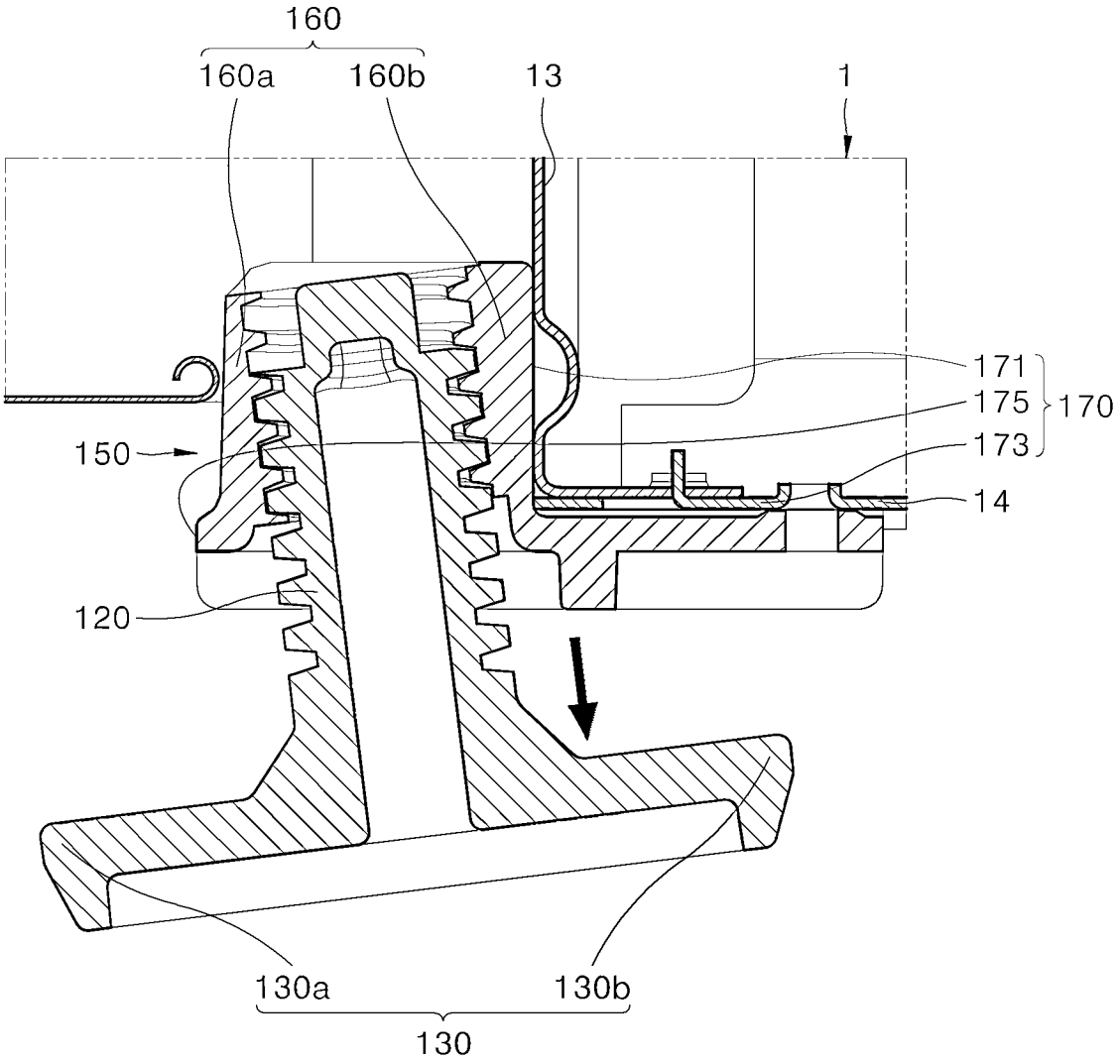

FIG. 6 is an exploded perspective view of a leg assembly shown in FIG. 5. FIG. 7 is a bottom view of the leg assembly shown in FIG. 5. FIG. 8 is a front view of the leg assembly shown in FIG. 5. In addition, FIG. 9 is a side view of the leg assembly shown in FIG. 5. FIG. 10 is a side cross-sectional view showing an internal structure of the connector shown in FIG. 9, and FIGS. 11 and 12 are side cross-sectional views showing an internal structure of the leg assembly shown in FIG. 9.

Referring to FIGS. 5 to 7, the supporter 110 may include a support shaft 120. The support shaft 120 may be disposed under the main body 1 and may be provided in a form of a shaft that extends in the vertical direction. The support shaft 120 is configured to be coupled to the connector 150 described hereinafter in an ascendable and descendable manner.

For example, the support shaft 120 may be provided in a form of a screw having a screw thread formed on an outer circumferential surface thereof. The support shaft 120 may be screwed to the connector 150, thereby being coupled to the main body 1 in the ascendable and descendable manner.

The supporter 110 may include a support 130. The support 130 may be in contact with the floor surface F and may support the support shaft 120 from below. The support 130 may be disposed beneath the support shaft 120.

The support 130 may form a plane that extends in a centrifugal (or radial) direction from the support shaft 120. For example, the support 130 may be formed in a flange shape that protrudes in the centrifugal (or radial) direction from the support shaft 120.

As an example, the support 130 may be formed integrally with the support shaft 120. The support 130 may be formed in a form that protrudes in the centrifugal (or radial) direction from a lower end of the support shaft 120.

As another example, the support 130 may be formed separately from the support shaft 120. The support 130 may be coupled to the lower end of the support shaft 120 and may be coupled to the connector 150 via the coupling with the support shaft 120.

In this embodiment, the support shaft 120 and the support 130 are illustrated as being formed integrally. For example, a surface of the support 130 that is in contact with the floor surface F, that is, a bottom surface of the support 130, may include a plane that that extends perpendicular to the support shaft 120. For example, the bottom surface of the support 130 may include a plane that extends perpendicular to the support shaft 120 and extends in the centrifugal (or radial) direction of the support shaft 120.

For example, the bottom surface of the support 130 may form a roughly circular plane, and the support shaft 120 may be disposed at a center of a circle formed by the support 130. The support shaft 120 may be provided in a form of a shaft that extends upward from a center of the support 130.

In addition, the support 130 may include a rim protrusion 131, as shown in FIGS. 8 and 11. The rim protrusion 131 may be formed in a shape in which a portion of the bottom surface of the support 130 protrudes downward. For example, the rim protrusion 131 may be disposed at a rim of the support 130.

For example, the rim protrusion 131 may be provided in a form in which a portion of the bottom surface of the support 130 adjacent to the rim protrudes downward. The rim protrusion 131 may be formed in a ring shape that surrounds the rim of the support 130.

That is, in an area of the bottom surface of the support 130 adjacent to the rim of the support 130, the rim protrusion 131 protruding downward from the bottom surface of the support 130 may be formed in the ring shape. In addition, a central area of the bottom surface of the support 130 surrounded by the rim protrusion 131 may be formed in a shape that is depressed upward compared to the rim protrusion 131.

An outer peripheral surface of the support 130 may be formed in a curved shape or an angular shape. For example, when the bottom surface of the support 130 is formed in the circular shape, the outer peripheral surface of the support 130 may be formed in the curved shape. As another example, when the bottom surface of the support 130 is formed in a polygonal shape similar to the circular shape, for example, a regular dodecagonal shape, the outer peripheral surface of the support 130 may be formed in the angular shape.

In this embodiment, the outer peripheral surface of the support 130 is illustrated as being formed in the angular shape. The outer peripheral surface of the support 130 formed as such may provide an angular surface for engagement of a tool, such as a spanner, with the support 130. A user may easily and quickly perform a task of lifting and lowering the supporter 110 by rotating the supporter 110 using the tool, such as the spanner.

The support 130 may be divided into a front area 130*a* and a rear area 130*b*. The front area 130*a* may include an area of the support 130 disposed in front of the support shaft 120. Further, the rear area 130*b* may include an area of the support 130 disposed at a rear of the support shaft 120.

In this embodiment, it is illustrated that the support 130 is divided into two equal areas: the front area 130*a* and the rear area 130*b*, and the front area 130*a* forms a front half of the support 130, and the rear area 130*b* forms a rear half of the support 130.

Referring to FIGS. 5 to 7, the connector 150 may include a boss 160 and a coupling portion 170. The boss 160 is configured to be coupled with the support shaft 120. Further, the coupling portion 170 is configured to couple the boss 160 to the main body 1.

The coupling portion 170 may include a front surface coupling portion 171. The front surface coupling portion 171 is configured to be coupled to the front surface of the main body 1 at a location in front of the main body 1.

For example, the front surface coupling portion 171 may be disposed in front of the second front panel 13 and may be coupled with the second front panel 13. The front surface coupling portion 171 may form a vertical plane that extends parallel to the second front panel 13, and may be coupled with the second front panel 13 while facing the second front panel 13 in the frontward and rearward direction.

For example, the front surface coupling portion 171 may be formed in an approximately square shape. For example, a vertical length of the front surface coupling portion 171 may be set to ⅓ or greater of a vertical length of the support shaft 120. A lower end of the front surface coupling portion 171 may be disposed at approximately a same location as a lower end of the second front panel 13.

With respect to the frontward and rearward direction, the front surface coupling portion 171 may be disposed between the boss 160 and the second front panel 13. For example, the boss 160 may be formed in a shape that protrudes forward from the front surface coupling portion 171.

A pair of fastening holes may be defined in the front surface coupling portion 171 laterally spaced apart from each other with the boss 160 interposed therebetween. A fastening member, such as a screw, may be inserted into each fastening hole. Each fastening member may extend through the front surface coupling portion 171 and the second front panel 13 in the frontward and rearward direction via the fastening hole, and may couple the front surface coupling portion 171 to the second front panel 13.

In addition, the coupling portion 170 may include a bottom surface coupling portion 173. The bottom surface coupling portion 173 is configured to be coupled to a bottom surface of the main body 1 from below the main body 1.

For example, the bottom surface coupling portion 173 may be disposed beneath the base frame 14 and may be coupled with the base frame 14. A top surface of the bottom surface coupling portion 173 may form a horizontal plane that extends parallel to the base frame 14, and may be coupled with the base frame 14 while facing a bottom surface of the base frame 14 in the vertical direction.

The bottom surface coupling portion 173 may be formed in a shape that protrudes rearward from the boss 160. A top surface of the bottom coupling portion 173 may form a plane that extends parallel to a bottom surface of the boss 160.

For example, a top surface of the bottom surface coupling portion 173 and the bottom surface of the boss 160 may be formed on a same plane. As another example, the top surface of the bottom surface coupling portion 173 and the bottom surface of the boss 160 may be formed on two parallel planes, respectively. In this embodiment, it is illustrated that the boss 160 and the bottom surface coupling portion 173 are formed integrally, and the top surface of the bottom surface coupling portion 173 and the bottom surface of the boss 160 are formed on the same plane.

In addition, the coupling portion 170 may further include a front extension 175. The front extension 175 may protrude forward from the bottom surface coupling portion 173. A top surface of the front extension 175 may form a plane that extends parallel to the top surface of the bottom surface coupling portion 173.

For example, the top surface of the bottom surface coupling portion 173 and the top surface of the front extension 175 may be formed on a same plane. As another example, the top surface of the bottom surface coupling portion 173 and the top surface of the front extension 175 may be formed on two parallel planes, respectively. In this embodiment, it is illustrated that the bottom surface coupling portion 173 and the front extension 175 are formed integrally, and the top surface of the bottom surface coupling portion 173 and the top surface of the front extension 175 are formed on the same plane.

The connector 150 may further include a support rib 177. The support rib 177 may be formed in a shape that protrudes forward from the front surface coupling portion 171 and protrudes upward from the front extension 175. For example, the support rib 177 may be formed in a shape that protrudes forward from a side end of the front surface coupling portion 171 and is connected to a side end of the front extension 175.

A pair of support ribs 177 may be laterally spaced apart from each other by a predetermined spacing. The support ribs 177 disposed as such may reinforce a rigidity of connection portions between the front surface coupling portion 171 and the front extension 175.

According to this embodiment, the boss 160 may protrude upward from the front extension 175. In this embodiment, it is illustrated that the front surface coupling portion 171, the bottom surface coupling portion 173, the front extension 175, and the boss 160 are formed integrally. In the connector 150 including those, the top surface of the bottom surface coupling portion 173, the top surface of the front extension 175, and the bottom surface of the boss 160 may be formed on a same plane.

The boss 160 may be formed in a cylindrical shape that protrudes upward from the front extension 175. For example, the bottom surface of the boss 160 may be connected to the front extension 175, and a portion of an outer circumferential surface of the boss 160 may be connected to the front surface coupling portion 171 disposed at the rear of the boss 160.

For example, a vertical length of the boss 160 may be set to correspond to the vertical length of the front surface coupling portion 171. Accordingly, the coupling between the boss 160 and the support shaft 120 may be achieved in an area with a sufficiently great length.

In addition, the connector 150 may further include a reinforcing rib 179. The reinforcing rib 179 may protrude from the boss 160 in a centrifugal (or radial) direction and be connected to the front extension 175. In other words, it may be said that the reinforcing rib 179 protrudes upward from the front extension 175 and is connected to the boss 160.

A plurality of reinforcing ribs 179 may be arranged at a predetermined spacing along a circumferential direction of the boss 160. The reinforcing ribs 179 arranged as such may be connected to the boss 160 and the front extension 175 to strengthen a rigidity of a connection portion between the boss 160 and the front extension 175.

Referring to FIGS. 9 to 11, a fastening hole 162 may be defined inside of the boss 160. The fastening hole 162 may open a lower end of the boss 160 and extend in the vertical direction. For example, the fastening hole 162 may extend through the boss 160 in the vertical direction. The support shaft 120 may be inserted into the boss 160 in the vertical direction via the fastening hole 162 and may be coupled with the boss 160.

For example, a female screw may be formed in an inner circumferential surface of the boss 160 surrounding the fastening hole 162. The support shaft 120 inserted into the boss 160 may be screw-connected with the boss 160. For example, the support shaft 120 may be screw-connected with the boss 160 so as to ascend and descend in a direction parallel to a direction in which the fastening hole 162 extends.

According to this embodiment, the boss 160 may be coupled to the support shaft 120 while supporting the support shaft 120 such that the support shaft 120 maintains a set or predetermined posture or position.

In this embodiment, it is illustrated that, when a posture of position of the support shaft 120 is the set or predetermined posture, the support 130 is in contact with the floor surface F at a location that is biased forward of the support shaft 120. To this end, the fastening hole 162 may be formed in a shape that extends in the vertical direction, but extends in a direction inclined in the frontward and rearward direction. For example, the fastening hole 162 may be inclined downwardly rearwards. In other words, the fastening hole 162 may be inclined upwardly forwards.

The support shaft 120 may be inserted into the fastening hole 162 in a direction parallel to the direction in which the fastening hole 162 extends, and may be coupled with the boss 160. The support shaft 120 may be coupled with the boss 160 while being supported by the boss 160 so as to maintain the set or predetermined posture.

As described above, the support shaft 120 may be screw-coupled with the boss 160. The support shaft 120, as shown in FIG. 12, may ascend and descend in the direction parallel to the direction in which the fastening hole 162 extends and maintain a state of being coupled to the boss 160. That is, the support shaft 120 may ascend and descend while maintaining the set or predetermined posture.

For example, the boss 160 may protrude upward from the front extension 175 or the bottom surface coupling portion 173 such that the vertical length of the boss 160 is at least ½ of the vertical length of the support shaft 120. That is, the vertical length of the boss 160 may be set to at least ½ of the vertical length of the support shaft 120.

As another example, a vertical length of the fastening hole 162 may be set to at least ½ of the vertical length of the support shaft 120. That is, the fastening hole 162 may be defined to have a length equal to or greater than ½ of the length of the support shaft 120. Accordingly, the coupling between the support shaft 120 and the boss 160 may be achieved not only in a partial section of the support shaft 120, but over a long section with a length close to ½ of the length of the support shaft 120.

Figure 13:
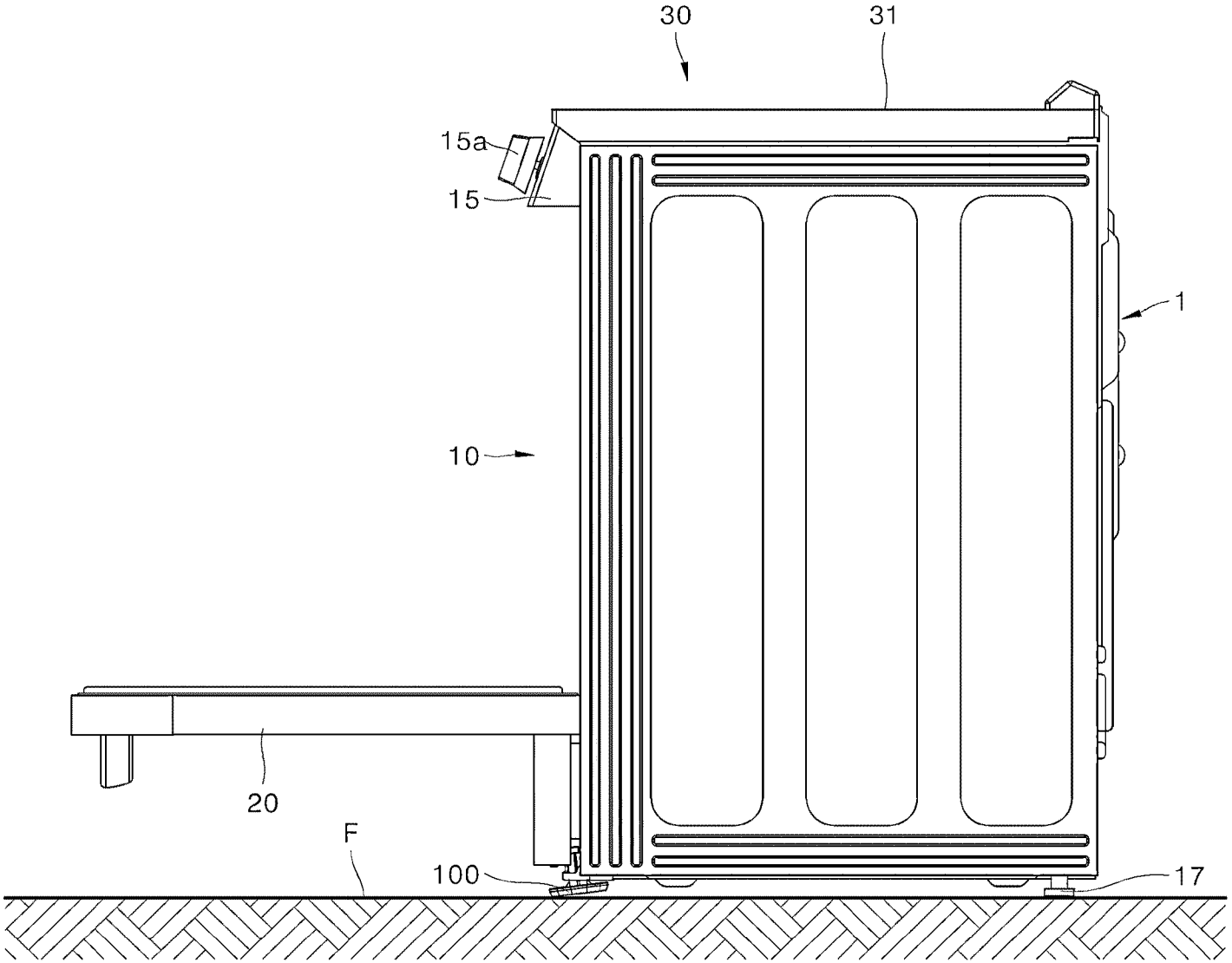
FIG. 13 is a side view of a door open state of a home appliance according to an embodiment.
Figure 14:
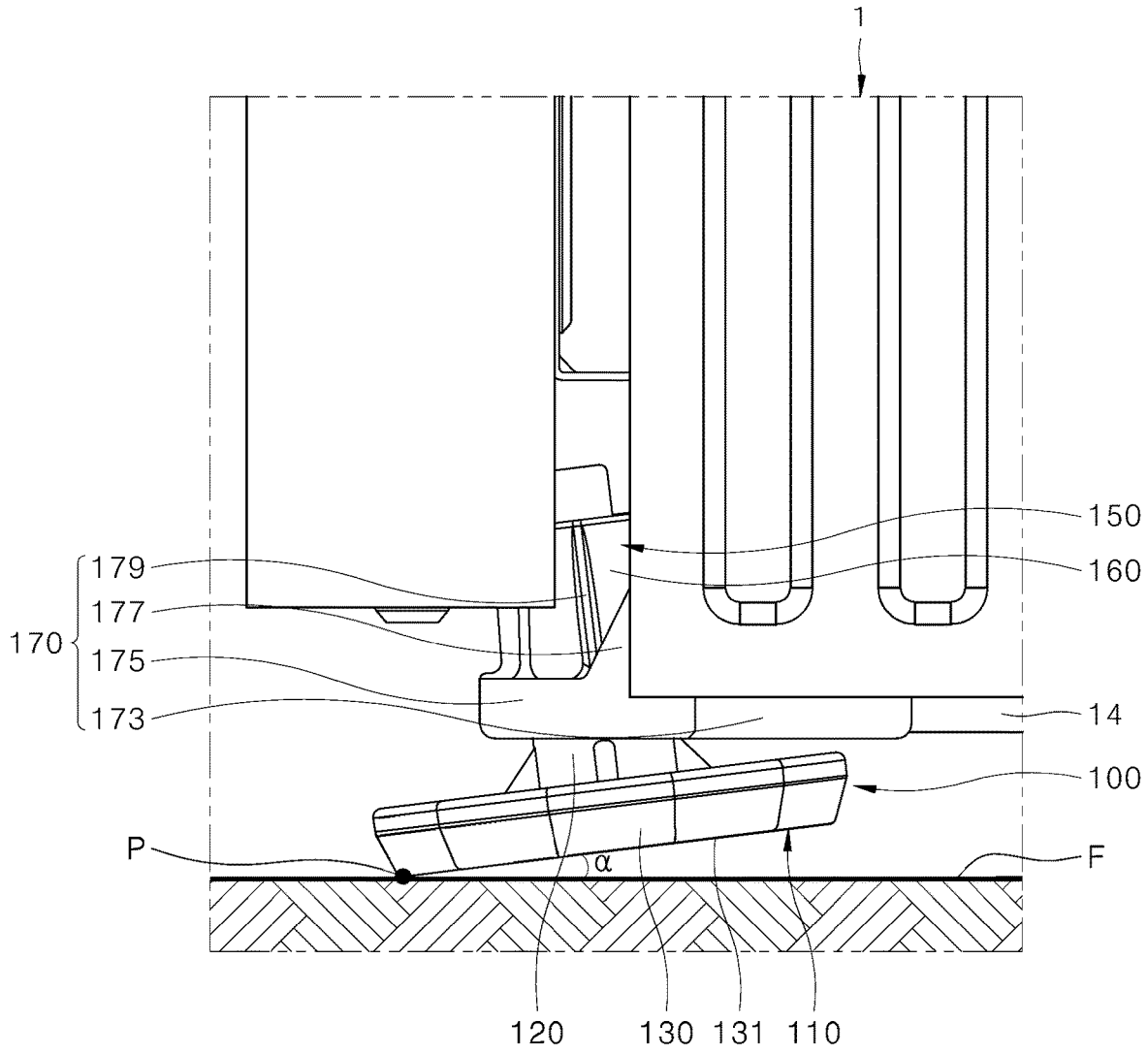
FIG. 14 is an enlarged view of the leg assembly shown in FIG. 13 in an enlarged manner.

FIG. 13 is a side view of a door open state of a home appliance according to an embodiment. FIG. 14 is an enlarged view of the leg assembly shown in FIG. 13.

Hereinafter, functions and effects of the home appliance according to an embodiment will be described with reference to FIGS. 11 to 14. Referring to FIG. 13, the home appliance may be supported by the leg assembly 100 and the rear leg 17. The leg assembly 100 and the rear leg 17 disposed beneath the main body 1 may support the main body 1 from below, and the home appliance may be installed on the floor surface F at a predetermined spacing upward from the floor surface F.

The leg assembly 100 and the rear leg 17 are arranged in the frontward and rearward direction, and the leg assembly 100 is able to support the main body 1 by making contact with the floor surface F at a location that is biased forward of the rear leg 17. That is, a contact point between the leg assembly 100 and the floor surface F may be disposed forward of a contact point between the rear leg 17 and the floor surface F.

Referring to FIGS. 11 to 14, the boss 160 may support the support shaft 120 and be coupled with the support shaft 120 such that the support shaft 120 maintains the set or predetermined posture. That is, the boss 160 may support the supporter 110 and be coupled with the supporter 110 such that the support shaft 120 and the supporter 110 including the support shaft 120 maintain the set or predetermined posture.

When the support shaft 120 maintains the set or predetermined posture, the support shaft 120 may maintain a state of being inclined in the frontward and rearward direction with respect to a virtual line (hereinafter, referred to as a "vertical virtual line") that extends vertically from the floor surface F. For example, when the support shaft 120 maintains the set or predetermined posture, the support shaft 120 may maintain a posture or position of being inclined upwardly forwards.

For example, when the posture of the support shaft 120 is the set or predetermined posture, the support shaft 120 may maintain a posture or position of being inclined in the frontward and rearward direction by a set or predetermined angle $\alpha$ with respect to the vertical virtual line. In this regard, the set or predetermined angle $\alpha$ may be set to an angle in a range of 5 to 10°, such as 7°.

The support 130 connected to a lower side of the support shaft 120 may maintain a state of being inclined with respect to the floor surface F. For example, when the support shaft 120 maintains the set or predetermined posture, the support 130 may maintain a state in which the bottom surface of the support 130 is inclined forwardly downwards.

For example, when the posture of the support shaft 120 is the set or predetermined posture, the support 130 may maintain a posture or position of being inclined vertically by the set or predetermined angle $\alpha$ with respect to the floor surface F. In this regard, the set or predetermined angle $\alpha$ may be set to the angle in the range of 5 to 10°, such as 7°. Accordingly, when the support shaft 120 maintains the set or predetermined posture, the support 130 may be in contact with the floor surface F at the location biased forward of the support shaft 120.

For example, when the posture of the support shaft 120 is the set or predetermined posture, at least a portion of the front area 130*a* of the support 130 may be in contact with the floor surface F, and the rear area of the support 130 may be spaced upwardly apart from the floor surface F. As another example, when the posture of the support shaft 120 is the set or predetermined posture, a front end of the bottom surface of the support 130 may be in contact with the floor surface F, and a rear end of the bottom surface of the support 130 may be spaced upwardly apart from the floor surface F.

Referring to FIGS. 13 and 14, the support 130 may be disposed beneath the support shaft 120, and may be formed in a shape that protrudes in the centrifugal (or radial) direction from the support shaft 120. A front end of the support 130 may be positioned at a location spaced forwardly apart from the support shaft 120 by a length corresponding approximately to a radius of the support 130.

When the posture of the support shaft 120 is the set or predetermined posture, a separation distance between the front end of the support 130 and the support shaft 120 may be slightly smaller than the radius of the support 130. For example, the front end of the support 130 may be disposed forward of the main body 1. Further, the front end of the support 130 may be disposed between a front end of the main body 1 and a front end of the door 20. For example, the support 130 may be provided in a shape that may protrude forward of the main body 1 but does not protrude forward of the door 20.

By the support 130 provided in this manner, a point of which contact between the leg assembly 100 and the floor surface F occurs, that is, a point (P; hereinafter, referred to as a "support point") of which the leg assembly 100 supports the main body 1 while being in contact with the floor surface F may be located at a point biased forward of the front end of the main body 1.

In addition, the support 130 provided as above may allow the support point P to be located forward and outward of the main body 1, while making it possible for the leg assembly 100 not to be easily visible to the user positioned in front of the home appliance.

In general, a center of gravity of the home appliance is located inside of the main body 1. Accordingly, a risk of the home appliance falling over is very low when the door 20 is closed. However, when the door 20 of the home appliance opens the cooking chamber and extends forward, the center of gravity of the home appliance moves further forward.

In particular, when a heavy object is placed on the door 20 opened as such, the center of gravity of the home appliance moves forwardly and outwardly of the home appliance. When the center of gravity of the home appliance is located forward and outward of the home appliance, a moment is applied to the home appliance centered on the contact point between the home appliance and the floor surface F. Such moment acts as a force that rotates the home appliance forward.

That is, as the center of gravity of the home appliance moves forward from the contact point between the home appliance and the floor surface F, the moment increases. Accordingly, the force that attempts to rotate the home appliance forward increases, so that the risk of the home appliance tipping over increases.

According to this embodiment, when the posture of the support shaft 120 is the set or predetermined posture, the support 130 may be in contact with the floor surface F at the location that is biased forward of the support shaft 120. Accordingly, the point of contact between the leg assembly 100 and the floor surface F, that is, the support point P, may be positioned forward of the support shaft 120, but may be positioned forward and outward of the main body 1.

As the support point P is positioned forward and outward of the main body 1, the support point P may be positioned forward of the center of gravity of the home appliance or very close to the center of gravity of the home appliance. Accordingly, a magnitude of the moment applied to the home appliance may be reduced, and thus, the risk of the home appliance tipping over may be effectively reduced.

As described above, the support shaft 120, which supports the support 130 such that the support point P is positioned forward and outward of the main body 1, may be coupled with the connector 150, more specifically, the boss 160, to maintain the set or predetermined posture.

According to this embodiment, as the support shaft 120 maintains the set or predetermined posture and thus supports the main body 1 in the inclined state, a horizontal force of a considerable magnitude is applied to the support shaft 120. When the coupling between the support shaft 120 and the connector 150 is made by coupling between a vertically short member, such as a nut, and the support shaft 120, the coupling between the support shaft 120 and the connector 150 has no choice but to be only made in a very short section of the support shaft 120.

In this case, when the horizontal force is applied to the support shaft 120, a stress has no choice but to be concentrated only in the very short section of the support shaft 120 coupled with the nut. When the stress is concentrated only in the very short section of the support shaft 120 as such, not only is a possibility of the support shaft 120 being deformed or damaged higher, but a risk of deformation or damage of the portion where the support shaft 120 and the connector 150 are coupled with each other also increases.

Considering the above, in this embodiment, the length of the boss 160 is set such that the coupling between the boss 160 and the support shaft 120 is made in a sufficiently long section. For example, as shown in FIGS. 10 and 11, the length of the boss 160 may be set such that the vertical length of the boss 160 is at least ½ of the vertical length of the support shaft 120, or the vertical length of the fastening hole 162 is at least ½ of the vertical length of the support shaft 120. Accordingly, when the support shaft 120 is fully inserted into the boss 160, the coupling between the boss 160 and the support shaft 120 may be achieved in the sufficiently long section with the length close to ½ of the length of the support shaft 120.

In this embodiment, it is illustrated that the vertical length of the boss 160 or the fastening hole 162 is at least ¾ of the vertical length of the support shaft 120. Accordingly, when the support shaft 120 is fully inserted into the boss 160, a significant area of the support shaft 120 may participate in the coupling with the boss 160.

As the coupling between the boss 160 and the support shaft 120 is achieved in the above form, when the horizontal force is applied to the support shaft 120, the stress may not be concentrated on the specific section of the support shaft 120, but may be distributed to the significant area of the support shaft 120. As the stress is distributed as such, a risk of deformation or breakage of the support shaft 120 may be effectively reduced. That is, as the coupling between the boss 160 and the support shaft 120 is achieved in the wide area as described above, even though the support shaft 120 supports the main body 1 in the inclined state, the possibility of the support shaft 120 being deformed or damaged may be greatly reduced, and the risk of deformation or damage of the coupling portion between the support shaft 120 and the connector 150 may also be effectively reduced.

In one example, the boss 160 may be divided into a front area 160*a* and a rear area 160*b*. The front area 160*a* may include an area of the boss 160 disposed in front of the fastening hole 162. Further, the rear area 160*b* may include an area of the boss 160 disposed at a rear of the fastening hole 162. In this embodiment, it is illustrated that the boss 160 is divided into two equal areas: the front area 160*a* and the rear area 160*b*, and the front area 160*a* forms a front half of the boss 160 and the rear area 160*b* forms a rear half of the boss 160.

When the supporter 110 supports the main body 1 while being in contact with the floor surface F at the support point P, the horizontal force is applied to the support shaft 120 as described above. Such a horizontal force may act as a force that attempts to rotate the support shaft 120 around a lateral shaft.

For example, with respect to a rotational center of the support shaft 120, the horizontal force may act rearwards at an upper portion of the support shaft 120, and the horizontal force may act forwards at a lower portion of the support shaft 120. Accordingly, the rear area 160*b* of the boss 160 receives the horizontal force acting rearwards, and the front area 160*a* of the boss 160 receives the horizontal force acting forwards. In this regard, the rear area 160*b* receives a greater force as it goes toward the upper portion of the rear area 160*b*, and the front area 160*a* receives a greater force as it goes toward the lower portion of the front area 160*a*.

Considering the above, the front area 160*a* forming the front half of the boss 160 may be formed to have a thickness that increases downward. In addition, the rear area 160*b* forming the rear half of the boss 160 may be formed to have a thickness that increases upward. Accordingly, the rear area 160*b* may effectively support the support shaft 120 that presses the rear area 160*b* with a greater force as it goes to the upper portion of the rear area 160*b*, and the front area 160*a* may effectively support the support shaft 120 that presses the front area 160*a* with a greater force as it goes to the upper portion of the front area 160*a*.

The boss 160 including the front area 160*a* and the rear area 160*b* formed in this manner may not only stably support the support shaft 120 such that the risk of deformation or damage of the support shaft 120 is reduced, but also effectively reduce the risk of deformation or damage of the boss 160 caused by the force applied by the support shaft 120.

For example, the connector 150 may be manufactured as an injection-molded product. The connector 150 may be formed by injection molding using a mold that is separated in the vertical direction. In the connector 150, the boss 160 may have a shape of a roughly vertically erected cylinder, that is, a cylinder shape extending in the vertical direction. This may be a result of designing the shape of the connector 150 to effectively extract the connector 150, which is the injection-molded product, from the mold.

In the boss 160 formed in the cylindrical shape as described above, the front area 160*a* may be formed to have a thickness that increases downward, and the rear area 160*b* may be formed to have a thickness that increases upward. In addition, the fastening hole 162 may be defined between the front area 160*a* and the rear area 160*b*, and the front area 160*a* and the rear area 160*b* may form the inner circumferential surface of the boss 160 that surrounds the fastening hole 162.

As described above, the fastening hole 162 is defined so as to be inclined at an angle in a range of 5° to 10° in the frontward and rearward direction with respect to the vertical virtual line. For example, the front area 160*a* and the rear area 160*b* may be formed as a result of the fastening hole 162 being defined inside the boss 160. That is, as the fastening hole 162 is defined so as to be inclined inside the cylindrical boss 160, the front area 160*a* and the rear area 160*b* may be naturally formed in the front half and the rear half of the boss 160.

In summary, because the boss 160 is formed in the cylindrical shape, the entire connector 150 including the boss 160 and the coupling portion 170 may be formed as the injection-molded product. Further, as the fastening hole 162 is defined to be inclined inside of the boss 160, the support shaft 120 may be coupled with the boss 160 while stably maintaining the set (or predetermined) posture. In addition, the front area 160*a* and the rear area 160*b* may be naturally formed in the front half and the rear half of the boss 160 by the fastening hole 162 defined inside of the boss 160.

As a result, the connector 150 may be manufactured easily and quickly at a low cost, and may not only support the supporter 110 such that the support shaft 120 maintains the set (or predetermined) posture, but also provide the effect of stably supporting the supporter 110 such that the risk of deformation or damage of the support shaft 120 is reduced.

Embodiments disclosed herein provide a home appliance that has an improved structure to reduce a risk of the home appliance tipping over.

Embodiments disclosed herein further provide a home appliance that may reduce a risk of deformation or damage of a leg assembly that supports the home appliance.

Embodiments disclosed herein furthermore provide a home appliance that has a leg assembly that may be manufactured at a low cost while reducing a risk of deformation or damage.

One embodiment for achieving the above purpose is a home appliance, which may include a support shaft coupled to a connector so as to be able to ascend and descend, a support member or support in contact with a floor surface and supporting the support shaft from below, a boss coupled to the support shaft, and a coupling portion coupling the boss to the main body. The boss may be coupled to the support shaft while supporting the support shaft such that the support shaft maintains a set or predetermined posture or position, and when a posture or position of the support shaft is the set or predetermined posture, the support member is in contact with the floor surface at a location biased forward of the support shaft. Accordingly, a support point of a leg assembly may be disposed forward and outward of the main body of the home appliance.

Further, another form may include a supporter in contact with a floor surface and supporting a main body from below, and a connector that couples the supporter to the main body. The connector may include a boss coupled to the supporter, and a coupling portion coupling the boss to the main body. The boss may extend upward from the coupling portion, and a fastening hole may be defined to be inclined inside of the boss.

A home appliance according to embodiment disclosed herein may include a main body with an internal space defined therein, a supporter that is in contact with a floor surface and supports the main body from below, and a connector that couples the supporter to the main body. The supporter may include a support shaft coupled to the connector so as to be able to ascend and descend, and a support member or support that is in contact with the floor surface and supports the support shaft from below.

The connector may include a boss coupled to the support shaft, and a coupling portion that couples the boss to the main body. The boss may be coupled to the support shaft while supporting the support shaft such that the support shaft maintains a set or predetermined posture or position. Further, when a posture or position of the support shaft is the set or predetermined posture, the support member is in contact with the floor surface at a location biased forward of the support shaft.

A fastening hole may be defined inside of the boss. The support shaft may be coupled with the boss while being inserted into the boss in a vertical direction via the fastening hole.

The fastening hole may open a lower end of the boss and extend in the vertical direction, but extend in a direction inclined in a frontward and rearward direction. Further, the support shaft may be inserted into the fastening hole in a direction parallel to the extending direction of the fastening hole to maintain the set or predetermined posture.

The fastening hole may be defined to be inclined downwardly rearwards. Further, a female screw may be formed in an inner circumferential surface of the boss surrounding the fastening hole, and the support shaft may be screw-coupled with the boss so as to be able to ascend and descend in a direction parallel to an extending direction of the fastening hole.

Further, the fastening hole may extend in the vertical direction, but extend so as to be inclined upwardly forwards. Furthermore, the support shaft may be screw-coupled with the boss so as to be able to ascend and descend while maintaining the set or predetermined posture. A vertical length of the fastening hole may be at least half of a vertical length of the support shaft.

The boss may include a front area positioned in front of the fastening hole and a rear area positioned at a rear of the fastening hole. A thickness of the front area may increase downwardly. Further, a thickness of the rear area may increase upwardly. Furthermore, a thickness of the rear area may increase upwardly, a thickness of the front area may increase downwardly, and a thickness of the boss may be uniform across a vertical height thereof.

The coupling portion may include a bottom surface coupling portion coupled to a bottom surface of the main body from below the main body. The bottom surface coupling portion may protrude rearwards from the boss.

A top surface of the bottom surface coupling portion in contact with the bottom surface of the main body, and a bottom surface of the boss may be formed on a same plane or may be respectively formed on two planes parallel to each other.

The coupling portion may further include a front extension that extends forward from the bottom surface coupling portion. Further, the boss may protrude upwards from the front extension. Furthermore, the top surface of the bottom surface coupling portion and a top surface of the front extension may be arranged parallel to each other or form a same plane.

The connector may further include a reinforcing rib that protrudes centrifugally or radially from the boss and connected to the front extension.

The boss may protrude upwards from the bottom surface coupling portion such that a vertical length of the boss is at least half of a vertical length of the support shaft. Further, the boss may protrude upwards from the front extension and protrude forwards from the front surface coupling portion.

The connector may further include a support rib that protrudes forwards from the front surface coupling portion and protrudes upwards from the front extension and is connected to the front surface coupling portion and the front extension. Further, the bottom surface of the support member in contact with the floor surface may be formed into a shape including a plane perpendicular to the support shaft and extending in a centrifugal or radial direction of the support shaft.

When the posture of the support shaft is the set or predetermined posture, at least a portion of a front area of the support member disposed in front of the support shaft may come into contact with the floor surface, and a rear area of the support member disposed at the rear of the support shaft may be spaced upwardly apart from the floor surface. Further, when the posture of the support shaft is the set or predetermined posture, a front end of the bottom surface of the support member may be in contact with the floor surface and a rear end is spaced upwardly apart from the floor surface. Furthermore, when the posture of the support shaft is the set or predetermined posture, at least a portion of a front area of the support member disposed in front of the support shaft may be disposed downward of the support shaft, and at least a portion of a rear area of the support member disposed at the rear of the support shaft may be disposed upward of a lower end of the support shaft.

The home appliance according to embodiments disclosed herein may effectively reduce the risk of the home appliance tipping over by allowing the support point of the leg assembly to be disposed forward and outward of the main body of the home appliance.

In addition, the embodiments disclosed herein may not only enable the support shaft to stably maintain the set or predetermined posture, but also effectively reduce the risk of deformation or damage of the support shaft and deformation or damage of the coupling portion between the support shaft and the connector by allowing the coupling between the supporter and the connector to be achieved such that the stress is not concentrated on a specific section of the support shaft but is distributed to a significant area of the support shaft.

In addition, the embodiments disclosed herein may provide a leg assembly that may be manufactured easily and quickly at low cost by allowing the entire connector to be formed as the injection-molded product.

In addition, the embodiments disclosed herein enable the entire connector including the coupling portion and the boss to be formed as an injection-molded product, and accordingly, enable the boss to be connected to the coupling portion without a separate task, such as welding or bonding, to connect the coupling portion with the boss, thereby not only reducing the cost and time required for manufacturing the connector, but also effectively improving a strength of coupling between the coupling portion and the boss.

In addition, the embodiments disclosed herein provide the connector designed to have different thicknesses at vertical locations of the front area and the rear area of the boss, thereby not only stably supporting the shaft, but also effectively reducing the risk of deformation or damage of the connector resulted from the force applied by the shaft in the process in which the shaft supports the home appliance.

Although embodiments disclosed herein have been described with reference to embodiments shown in the drawings, these are merely exemplary, and those skilled in the art will understand that various modifications and equivalent other embodiments are available from this. Accordingly, the true technical protection scope should be determined by the following patent claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" for example, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A home appliance, comprising:

a main body having an internal space defined therein;

a supporter that is in contact with a floor surface and supports the main body from below; and a connector that couples the supporter to the main body, wherein the supporter includes a support shaft coupled to the connector so as to be able to ascend and descend, and a support that is in contact with the floor surface and supports the support shaft from below, wherein the connector includes a boss coupled to the support shaft, and a coupling portion that couples the boss to the main body, wherein the boss is coupled to the support shaft while supporting the support shaft such that the support shaft maintains a predetermined posture, wherein when a posture of the support shaft is the predetermined posture, the support is in contact with the floor surface at a location biased forward of the support shaft, wherein a fastening hole is defined inside of the boss, wherein the support shaft is coupled with the fastening hole of the boss by being inserted into the boss in a vertical direction, wherein the boss includes a front area positioned at a front of the fastening hole and a rear area positioned at a rear of the fastening hole, and wherein a thickness of the front area increases downwardly, a thickness of the rear area increases upwardly, or both.

2. The home appliance of claim 1, wherein the fastening hole extends through a lower end of the boss and extends in the vertical direction at an incline in a frontward and rearward direction, and wherein the support shaft is inserted into the fastening hole in a direction parallel to an extending direction of the fastening hole to maintain the predetermined posture.

3. The home appliance of claim 2, wherein the fastening hole is inclined downwardly rearwards.

4. The home appliance of claim 1, wherein a female screw is formed in an inner circumferential surface of the fastening hole, and wherein the support shaft is screw-coupled with the boss so as to be able to ascend and descend in a direction parallel to an extending direction of the fastening hole.

5. The home appliance of claim 4, wherein the fastening hole extends in the vertical direction at an incline upwardly forwards, and wherein the support shaft is screw-coupled with the boss so as to be able to ascend and descend while maintaining the predetermined posture.

6. The home appliance of claim 1, wherein a vertical length of the fastening hole is at least half of a vertical length of the support shaft.

7. The home appliance of claim 1, wherein:

the thickness of the front area increases downwardly, the thickness of the rear area increases upwardly, and a width of the boss is uniform across a vertical height thereof.

8. The home appliance of claim 1, wherein the coupling portion includes a bottom surface coupling portion coupled to a bottom surface of the main body from below the main body, and wherein the bottom surface coupling portion protrudes rearwards from the boss.

9. The home appliance of claim 8, wherein a top surface of the bottom surface coupling portion in contact with the bottom surface of the main body, and a bottom surface of the boss are formed on a same plane or are respectively formed on two planes that extend parallel to each other.

10. The home appliance of claim 9, wherein the coupling portion further includes a front extension that extends forward from the bottom surface coupling portion, and wherein the boss protrudes upwards from the front extension.

11. The home appliance of claim 10, wherein the top surface of the bottom surface coupling portion and a top surface of the front extension extend parallel to each other or form a same plane.

12. The home appliance of claim 10, wherein the connector further includes at least one reinforcing rib that protrudes radially from the boss and is connected to the front extension.

13. The home appliance of claim 8, wherein the boss protrudes upwards from the bottom surface coupling portion such that a vertical length of the boss is at least half of a vertical length of the support shaft.

14. The home appliance of claim 1, wherein the coupling portion includes a front surface coupling portion coupled to a front of the main body, and a front extension that protrudes forward from the front surface coupling portion, and wherein the boss protrudes upwards from the front extension and protrudes forwards from the front surface coupling portion.

15. The home appliance of claim 14, wherein the connector further includes at least one support rib that protrudes forwards from the front surface coupling portion and upwards from the front extension and is connected to the front surface coupling portion and the front extension.

16. The home appliance of claim 1, wherein when the posture of the support shaft is the predetermined posture, at least a portion of a front area of the support disposed at a front of the support shaft comes into contact with the floor surface, and a rear area of the support disposed at a rear of the support shaft is spaced upwardly apart from the floor surface.

17. The home appliance of claim 1, wherein when the posture of the support shaft is the predetermined posture, at least a portion of a front area of the support disposed at a front of the support shaft is disposed below the support shaft, and at least a portion of a rear area of the support disposed at a rear of the support shaft is disposed above of a lower end of the support shaft.

18. A home appliance, comprising:

a main body having an internal space defined therein;

a supporter that is in contact with a floor surface and supports the main body from below; and a connector that couples the supporter to the main body, wherein the supporter includes a support shaft coupled to the connector so as to be able to ascend and descend, and a support that is in contact with the floor surface and supports the support shaft from below, wherein the connector includes a boss coupled to the support shaft, and a coupling portion that couples the boss to the main body, wherein the boss is coupled to the support shaft while supporting the support shaft at a predetermined position, in which position the support shaft is inclined in a forward direction, wherein when a position of the support shaft is the predetermined position, the support is in contact with the floor surface at a location biased forward of the support shaft and a lower surface of the support is disposed at an angle with respect to the floor surface, wherein a fastening hole is defined inside of the boss, wherein the support shaft is coupled with the fastening hole of the boss by being inserted into the boss in a vertical direction, wherein the boss includes a front area positioned at a front of the fastening hole and a rear area positioned at a rear of the fastening hole, and wherein a thickness of the front area increases downwardly, a thickness of the rear area increases upwardly, or both.

19. The home appliance of claim 18, wherein the fastening hole is inclined downwardly rearwards.

20. The home appliance of claim 18, wherein the angle is in a range of 5 to 10°.

21. The home appliance of claim 18, wherein a female screw is formed in an inner circumferential surface of the fastening hole, and wherein the support shaft is screw-coupled with the boss so as to be able to ascend and descend in a direction parallel to an extending direction of the fastening hole.

* * * * *